United States Patent [19]

Seiple

[11] Patent Number: 5,076,170

[45] Date of Patent: Dec. 31, 1991

[54] UNDERWATER WEAPON DISPENSER

[75] Inventor: Ronald L. Seiple, Kailua, Hi.

[73] Assignee: The United States of America as represented by the Secretary of the Navy, Washington, D.C.

[21] Appl. No.: 800,606

[22] Filed: May 18, 1977

[51] Int. Cl.[5] ..... F42B 22/00; B63G 6/00

[52] U.S. Cl. ..... 102/411

[58] Field of Search ..... 102/13, 14

[56] References Cited

U.S. PATENT DOCUMENTS

| | | | |
|---|---|---|---|
| 1,039,254 | 9/1912 | Carteron | 102/13 |
| 1,309,121 | 7/1919 | Elia | 102/13 |
| 3,084,627 | 4/1963 | Holm | 102/13 |
| 3,811,379 | 5/1974 | Sondheimer | 102/13 |
| 3,838,642 | 10/1974 | Shimberg | 102/13 |

*Primary Examiner*—Charles T. Jordan

*Attorney, Agent, or Firm*—Harvey Fendelman; Thomas Glenn Keough; Ervin F. Johnston

[57] ABSTRACT

The invention is an underwater weapon dispenser for delivering weapons to a location which is remote from a water vehicle. The dispenser includes at least one pod which is capable of receiving at least one weapon system, such as torpedo or mines. The pod is hydrodynamically shaped and is slightly negatively buoyant. The pod has at least one hydrofoil so that the pod will assume a glide path in the water. Provision is made for releasably attaching the pod with its weapon to the water vehicle so that the pod can be released from the water vehicle to assume a downward glide angle path. The pod is provided with a releasable anchor which, upon release, anchors the now buoyant pod at a predetermined depth. With this arrangement, pods can be attached to the bottom hull portion of a surface vessel or a submarine for delivering the pods with their weapons to the bottom of the ocean, after which the weapons can be removed for accomplishing their intended purposes.

13 Claims, 3 Drawing Sheets

UNDERWATER WEAPON DISPENSER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Mine warfare has always been an effective tool for protecting friendly harbors or neutralizing enemy harbors. In the Revolutionary War a colonist named Bushnell fitted some powder kegs with a gun lock and hammer exploders and used them as contact mines to destroy British river traffic. By the time of World War I mines had become quite sophisticated and became essential in many military operations. During that war the allies bottled up the German U-boats in the North Sea by laying an enormous barrage of mines between Norway and Scotland so that the allies could use their Atlantic shipping routes with reasonable safety. By WWII many varied systems of mines were utilized and numerous mine laying vessels were involved in laying extensive fields of controlled and uncontrolled mines. The most recent use of mines was in the mining of Hypong Harbor. This operation demonstrated that mine warfare is still an excellent weapon system and one of the most cost effective in existence. In all of these operations, however, it has been very difficult to plant these mines covertly, especially when the mines are planted as an offensive weapon in an enemy harbor or other designated area. The presence of a mine laying ship obviously gives away the presence of the mine laying operation. In recent history most of the mine laying ships have been scrapped and mine laying is now accomplished by aircraft. Mine laying from aircraft has the same problem as mine laying from surface ships, namely giving away the location of the operation.

Submarines have the capability of laying mines. However, in order to lay mines the submarine must sacrifice its complement of torpedoes. In addition, the newer class submarines are not safe in the shallow waters next to harbors where mines are most effective. These are two very important factors not desirable to submarine commanders. If mines are to be deployed clandestinely a system is needed that would not jeopardize the submarines' present weapon system and yet would provide a safe standoff position for effective, clandestine mine planting.

SUMMARY OF THE INVENTION

The present invention provides a system to enable a submarine to lay various types of mines in restricted enemy waters with sufficient standoff position and without any depletion of their present weapon system. This system would require very little modification to the submarine and the effects of its presence would be minimal (including acoustic signature). This has been accomplished by providing an underwater weapon dispenser which includes at least one pod which is capable of receiving a system of weapons. The pod is hydrodynamically shaped and is slightly negatively buoyant. The pod has at least one hydrofoil so that the pod will assume a glide path in the water. The pod is attached to the hull of the submarine in such a way that it can be easily released from inside to assume the downward glide path in the water. The pod has a releasable anchor which, upon release, makes the pod with its weapon buoyant in the water so that the pod will, upon reaching the bottom of the water, be anchored in a moored condition. With this arrangement a plurality of torpedoes can be released from the bottom of the submarine in pods which glide to the bottom of the ocean, after which the torpedoes can be debarked for assuming their offensive mode in enemy waters.

OBJECTS OF THE INVENTION

An object of the present invention is to provide an apparatus and method for covert planting of mines in enemy waters.

A further object is to provide a system for covert planting of mines from a water vehicle without any substantial alteration of such vehicle.

Another object is to provide a system for covertly dispensing mines in enemy waters from a submarine without any substantial alteration to the submarine.

These and other objects of the invention will become more readily apparent from the ensuing specification when taken together with the drawings.

DESCRIPTION OF THE PREFERRED EMBODIMENT

Figure 7:
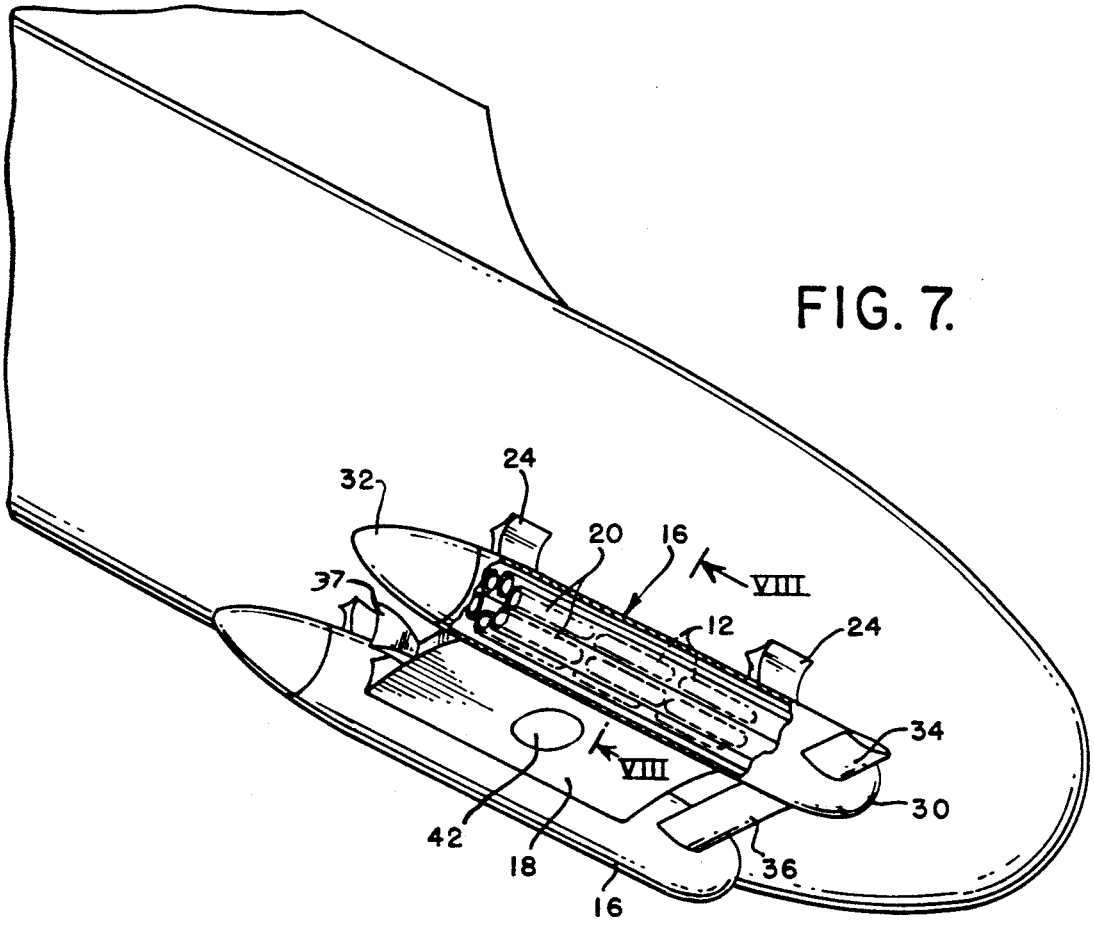
FIG. 7 is an enlarged isometric view of the underwater weapon dispenser mounted to the bottom of the submarine with a portion of one pod cut away to show a plurality of torpedoes mounted therein.
Figure 8:
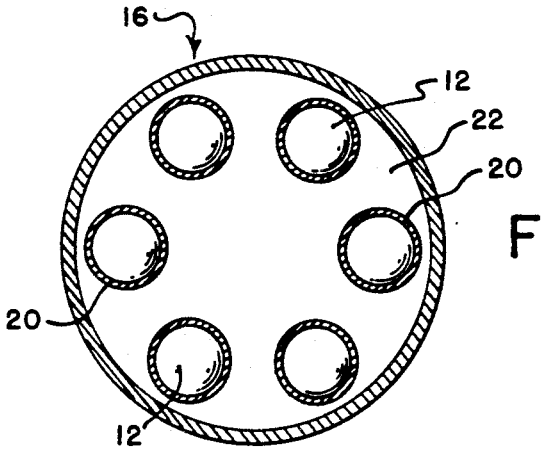
FIG. 8 is a cross-sectional view taken along plane VIII—VIII of FIG. 7.

Referring now to the drawings wherein like reference numerals designate like or similar parts throughout the several views there is illustrated in FIGS. 1 through 6 an underwater weapon dispenser 10 to delivering a weapon, such as a torpedo 12, to a location which is remote from a water vehicle such as a submarine 14. As illustrated in FIGS. 7 and 8 the weapon dispenser includes as least one pod 16 which is capable of receiving at least one torpedo 12. In the preferred embodiment a pair of pods 16 interconnected by a cross member 18 is utilized, and each pod is capable of carrying a plurality of the torpedoes 12. The torpedoes 12 may be mounted in consecutive circular rows inside tubes 20. The tubes 20 may be radially positioned within the pod 16 by a series of plates 22 positioned along the inside of the pod, one of these plates 22 being illustrated in FIG. 8. The torpedoes 12 may be the Navy's Mark 37 type which is self-actuated, self-propelled, and when emplaced serves the purpose of an underwater mine.

Figure 9:
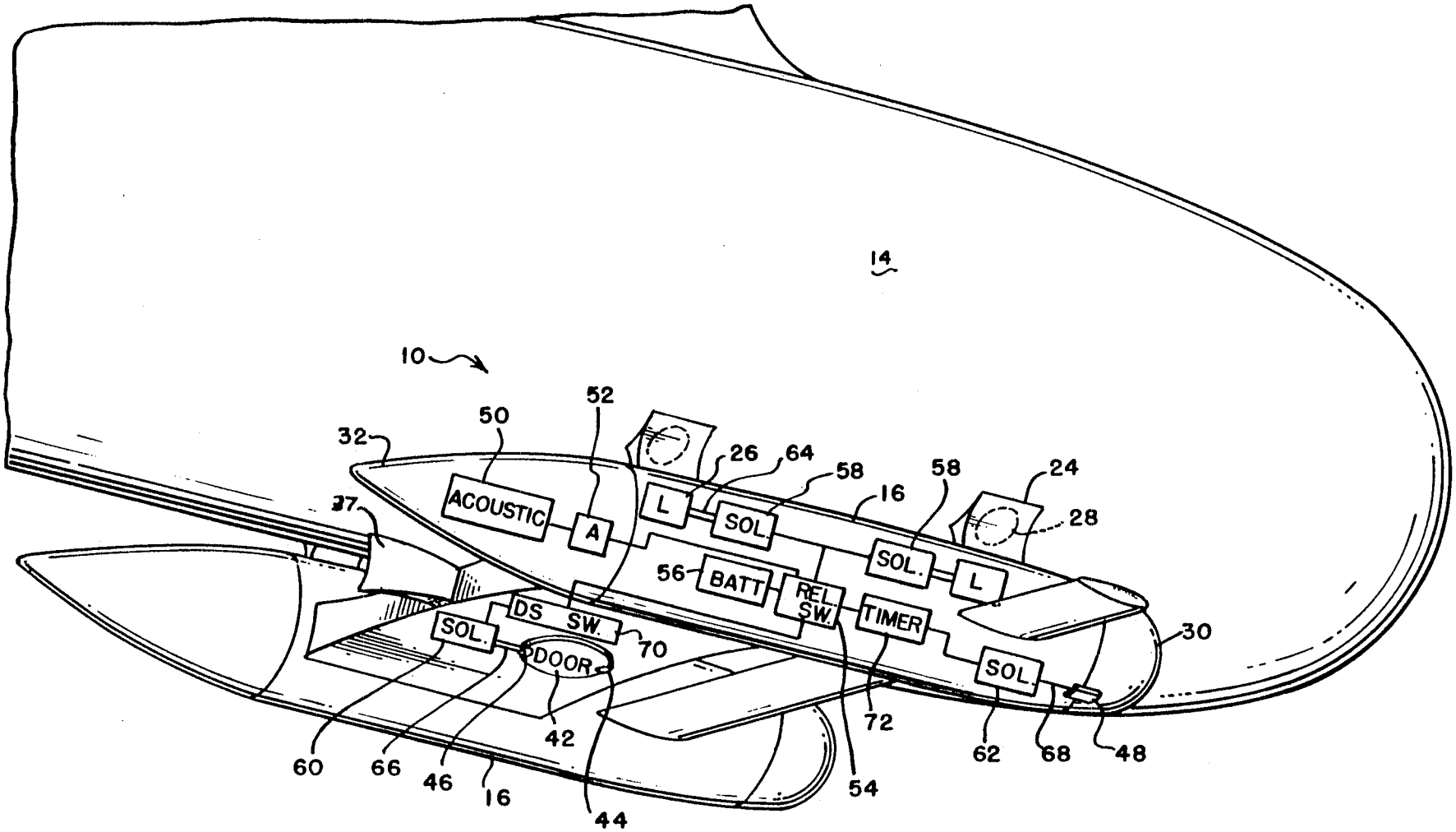
FIG. 9 is an enlarged isometric view of the underwater weapon dispenser mounted to the bottom of the submarine with the various components illustrated in block diagram form.

Means, such as metallic struts 24, may be provided for releasably attaching the pods 16 to the bottom hull portion of the submarine 14. A pair of struts 24 may be provided for each pod 16. The bottom end of each strut may be releasably connected to a top portion of each pod 16 by a respective latch 26, as illustrated in FIG. 9. The operation of these latches will be described in detail hereinbelow. The top portions of each strut 24 may be secured to the bottom metallic hull portion of the submarine by respective electromagnets 28 which are located within the submarine and have their fields operating through the metallic hull and into the respective metallic struts 24. A simple termination of the fields of these electromagnets 28 would jettison the weapon dispenser 10 for emergency or operational purposes.

Figure 2:
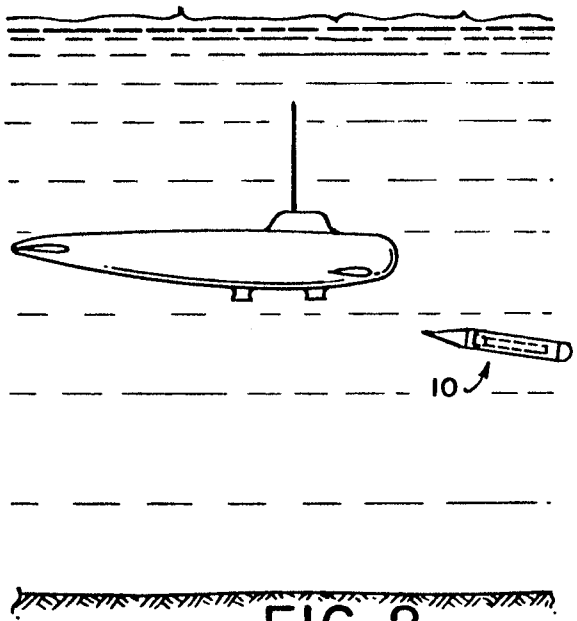
FIG. 2 is an ocean elevation view of a submarine with the underwater weapon dispenser launched therefrom.
Figure 3:
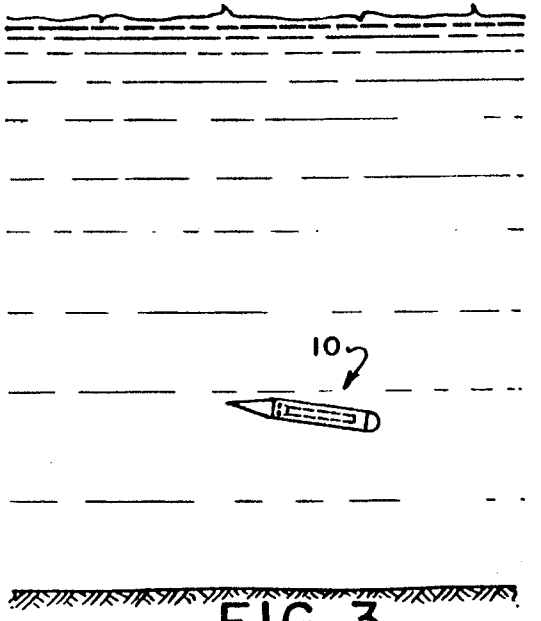
FIG. 3 is an ocean elevational view of the underwater weapon dispenser in a downward glide path to the bottom of the ocean.

As illustrated in FIGS. 7 and 8 each pod 16 is hydrodynamically shaped. The shape may be generally cylindrical with a rounded forward or nose portion 30 and a generally ogive tail portion 32. The weapon dispenser 10 with its torpedoes 12 is negatively buoyant, and has at least one hydrofoil 34 so that the weapon dispenser will assume a downward glide path in the water when released from the submarine, as illustrated in FIGS. 2 and 3. When a pair of pods 16 is utilized an interconnecting hydrofoil strut 36 and another hydrofoil 34 (not shown) on the port pod 16 may be utilized. If desired, a rudder 37 may be mounted on the cross-member 18 and operated by an inertial guidance system (not shown) for guiding the weapon dispenser 10 in its downward glide to the bottom of the ocean.

Figure 4:
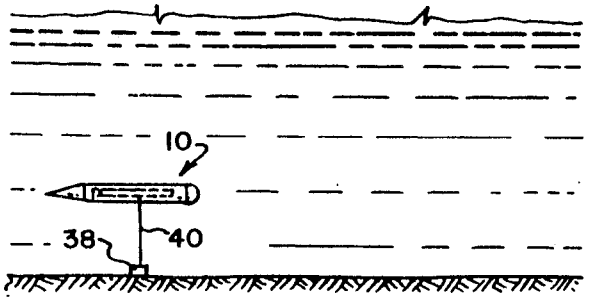
FIG. 4 is an ocean elevation view of the underwater weapon dispenser anchored on the bottom of the ocean.
Figure 5:
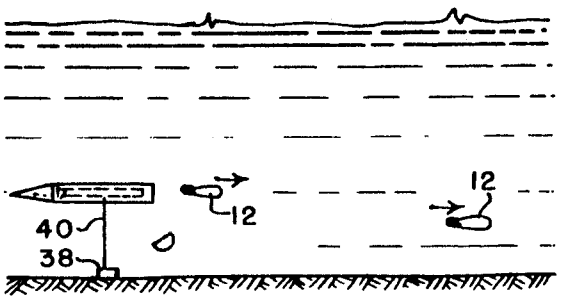
FIG. 5 is an ocean elevation view of a weapon fired from the underwater weapon dispenser after a nose portion has been released therefrom.
Figure 6:
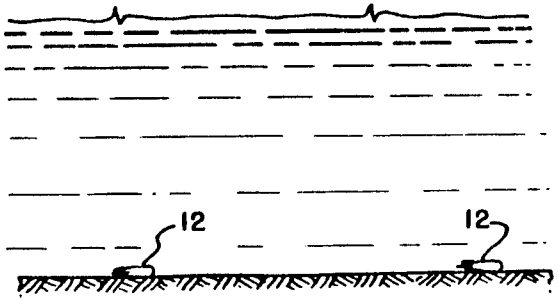
FIG. 6 is an ocean elevation view of a weapon of the ocean floor in an offensive mode.

The weapon dispenser 10 may be made negatively buoyant by a releasable anchor 38, as illustrated in FIG. 4, which, upon release, makes the weapon dispenser with its torpedoes buoyant in the water, as illustrated in FIGS. 4 and 5, so that the weapon dispenser will, upon reaching the bottom of the ocean be anchored in a moored condition, as illustrated in FIGS. 4 and 5. The anchor 38 may be mounted within a recess within the cross-member 18 and may be connected therein by a line 40. The anchor 38 may be simply dropped from the cross-member at the appropriate time by a door 42 which is pivoted to the bottom of the cross member 18 by a hinge 44. The door 42 may be opened at the appropriate time by a latch 46 which is actuated by a means which will be described in detail hereinbelow. Whether one or a plurality of torpedoes 12 are mounted within a pod or pods 16 the anchor 38 should be of a sufficient weight to anchor the weapon dispenser 10 on the bottom of the ocean while all torpedoes are fired therefrom, as illustrated in FIG. 5.

Each pod 16 may be provided with a releasable forward end portion 30 which may be dropped from the remainder of the respective pod at an appropriate time by a plurality of latches 48 only one of such latches being illustrated in FIG. 9 for one of the pods 16. The operation of these latches 48 will be described in detail hereinbelow. As illustrated in FIG. 5, the removal of the forward nose portion 30 of each pod enables the torpedo or torpedoes 12 to be released therefrom. The nose portions 30 are preferably released after the weapon dispenser is anchored at the bottom of the water.

An exemplary means for operating the various latches 26, 46, and 48 is illustrated schematically in FIG. 9. A hydrophone 50 mounted in one of the pods 16 may be utilized for commencing all of the releasing operations. This hydrophone 50 may be operated by an acoustic signal from the submarine's sonar, and the output signal of the hydrophone 50 may be enlarged by an amplifier 52. A normally closed relay switch 54 may be utilized for switching on power from a battery 56, the relay switch being switched to the "on" condition by the amplified signal from the hydrophone 50. The relay switch 54 may connect the battery output to respective longitudinal solenoids 58, 60, and 62. Each of the longitudinal solenoids operates a respective pin in a reciprocal fashion, the solenoids 58 operating pins 64, the solenoid 60 operating pin 66 and the solenoid 62 operating the respective pin 68. When battery power is applied to each of these solenoids the corresponding pin is retracted from a respective latch so as to release the component held thereby.

When the solenoids 58 are operated the pins 64 are retracted to open the latches 26 and drop the weapon dispenser 10 from the struts 26 and the submarine 14. This releasing action will take place almost immediately upon the actuation of the hydrophone 50.

When the solenoid 60 is actuated the pin 66 is withdrawn to open the latch 46 and allow the door to pivot downwardly. This, in turn, allows the anchor 38 to be dropped from the recess within the cross-member 18 for anchoring the weapon dispenser on the bottom of the ocean. The operation of the solenoid 60 is delayed in its operation by a depth sensor switch 70 which is interconnected between the relay switch 54 and the solenoid 60. The depth sensor switch 70 is programmed to operate at a predetermined depth in the ocean so that the anchor 38 will be released shortly before the weapon dispenser 10 reaches the bottom of the water. This depth will be known since the submarine personnel will know the depth of the water at the planned anchor location of the weapon dispenser. However, if the bottom of the water is a sandy bottom a timer (not shown) could be substituted for the depth sensor switch 70 and the weapon dispenser could come to rest on the sandy bottom after which the switch could operate the solenoid 60 to open the door 42 and release the anchor 38.

A pair of the solenoids 62 along with a respective pin 68 and latch 48 may be utilized for opening each respective forward end portion 30 of the pods 16, only one of such combinations being illustrated in FIG. 9. When the solenoids 62 are actuated the pins 68 are withdrawn from the latches 48 to release the nose portions 30 from the forward ends of each pod 16. This is illustrated in FIG. 5 of the drawings. It is preferred that this operation be delayed by a timer 72 which is interconnected between the relay switch 54 and the solenoid 62. The timer 72 should be set such that the solenoid 62 is actuated for releasing purposes after the pod 10 has been anchored as illustrated in FIG. 4.

It is to be understood that the mounting of the various latches 26, 46, and 48, and the longitudinal solenoids 58, 60, and 62 may be identical for each respective pod 16, with the hydrophone 50, amplifier 52, relay switch 54, battery 56, depth sensor switch 70, and timer 72 being utilized in common for operating both sets of these components.

If desired the dispenser could be provided with means for oscillating the glide paths between negative and positive after the dispenser has reached a predetermined depth so that the weapon system can reach a safe standoff position from the submarine. With this arrangement the dispenser would assume the negative glide angle until it reaches the predetermined depth. At this point the dispenser could release a weight and change its buoyancy from slightly − to slightly +. The dispenser would then remain on its glide path approaching the surface. Again at a pre-set depth a chamber in the dispenser would be flooded causing the dispenser to assume a downward glide angle. This sequence is done one or more times depending upon the desired distance for submarine safe standoff. The pod could carry its own inertial guidance computer package which would be updated upon departure. The computer would determine glide paths and correct for direction.

The method of the invention involves the delivering of an object, such as one or a plurality of torpedoes 12 from a water vehicle, such as a submarine 14, to a remote location. As illustrated in FIGS. 1 through 6 the various steps of the method include mounting the torpedo 12 in a pod 16 mounting the pod 16 to the submarine 14, releasing the pod 16 from the submarine, downwardly gliding the pod in the water, anchoring the pod at the bottom of the water, mooring the pod above the bottom of the water, and opening the pod and removing the torpedo therefrom. In the method one or a pair of pods may be utilized as described in the apparatus hereinabove.

OPERATION OF THE INVENTION

Figure 1:
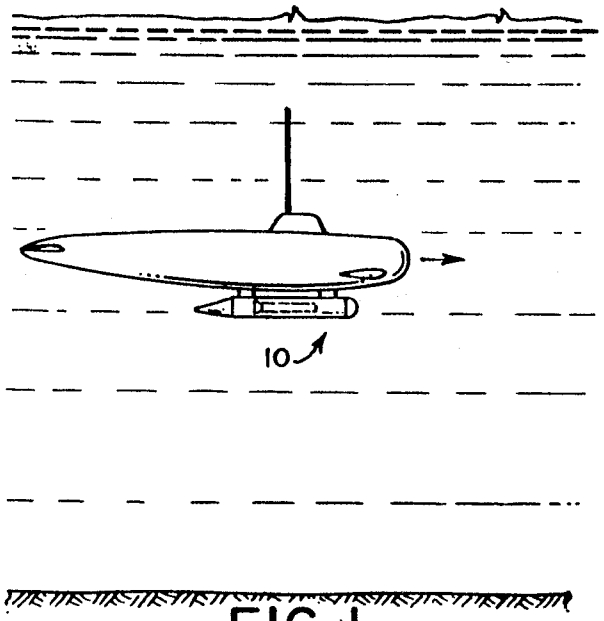
FIG. 1 is an ocean elevation view of a submarine with the underwater weapon dispenser attached thereto.

In the operation of the invention the submarine personnel preplan the deployment of the weapon dispenser 10 in a particular ocean area. This area, which may be an enemy area which is to be neutralized by torpedo mines, is generally known for its depth and current conditions through intelligence data. The pods 16 may be loaded with various torpedoes 12 at a shore station and then submerged for mounting to the bottom of a submarine, as illustrated in FIG. 1. The submarine need not be modified since the struts 24 are affixed at their tops to the bottom of the submarine by electromagnets 28, and the pods 16 are connected to the bottom of the struts by latches 26. The depth sensor switch 70 is set to operate at a depth slightly above the bottom of the water where the dispenser will be deployed. The timer 72 is set to operate shortly after the weapon dispenser 10 is anchored. Once the submarine has reached a location which will enable the weapon dispenser to glide downwardly through the water to the planned location the hydrophone 50 is actuated by a signal from the submarine, such as from its sonar. The hydrophone output signal is then amplified by the amplifier 52 to close the normally open relay switch 54, which in turn applied battery power to the various longitudinal solenoids 58, 60 and 62. This immediately causes the solenoids 58 to release the weapon dispenser 10 from the submarine to commence its downward glide path as illustrated in FIGS. 2 and 3. When the submarine has reached a predetermined depth the longitudinal solenoid 60 is operated to open the door 42 which, in turn, drops the anchor 38, this particular sequence not being illustrated in the drawings. After the weapon dispenser has become anchored on the bottom of the water, as illustrated in FIGS. 4 and 5, the longitudinal solenoids 62 (only one solenoid being shown in FIG. 9) release the nose portions 30 of the pods 16 so as to enable the release of the torpedoes 12. The torpedoes 12 are preprogrammed to actuate at a particular time and depart from the pods for travel to a still further remote location for final deployment. The Navy's Mark 37 torpedo can be programmed to start its propeller motors at a particular time to travel to the remote location, after which the torpedo rests on the bottom of the ocean and serves as a mine to neutralize enemy areas. This entire operation can be accomplished in a covert fashion since the submarine never transcends the area of mine emplacement, and there is no indication to the enemy of the purpose of the submarine. The only possible noise would be the motors of the torpedoes which are very quiet and in all probability would not be detected.

Obviously, many modifications and variations of the present invention are possible in the light of the above teachings, and, it is therefore understood that the invention may be practiced otherwise than as specifically described.

What is claimed is:

1. An underwater weapon dispenser for delivering a weapon to a location which is remote from a water vehicle comprising:

at least one pod which is capable of receiving at least one weapon;

means for releasably attaching the pod with the weapon to the water vehicle;

said pod being hydrodynamically shaped;

the dispenser with its weapon being negatively buoyant and having at least one hydrofoil so that the pod will assume a downward glide path in the water when released from the water vehicle; and said pod having a releasable anchor which, upon release, makes the pod with its weapon buoyant in the water so that the pod will, upon reaching the bottom of the water, be anchored in a moored condition.

2. A delivery system as claimed in claim 1 including:

depth sensing means for releasing the anchor when the pod is at a predetermined depth in the water.

3. A delivery system as claimed in claim 1 including:

a pair of said pods;

a cross-member interconnecting said pods; and said releasable anchor being mounted in the cross-member.

4. A delivery system as claimed in claim 1 including:

said pod having a releasable forward end portion for allowing exit of the weapon.

5. A delivery system as claimed in claim 1 including:

a plurality of weapons being mounted in the pod; and said releasable anchor anchoring the pod while all weapons are removed therefrom.

6. A delivery system as claimed in claim 5 including:

each of the weapons being a torpedo.

7. A delivery system as claimed in claim 6 including:

depth sensing means for releasing the anchor when the pod is at a predetermined depth in the water.

8. A delivery system as claimed in claim 7 including:

a pair of said pods;

a cross-member interconnecting said pods; and said releasable anchor being mounted in the cross-member.

9. A delivery system as claimed in claim 8 including:

each pod having a releasable forward end portion for allowing exit of the torpedoes; and means for releasing the forward end portion of each pod after the pods are anchored at the bottom of the water.

10. A delivery system as claimed in claim 9 including:

the water vehicle having a metallic hull;

downwardly extending struts interconnecting the pods to the hull of the water vehicle; and magnetic means for connecting the tops of the downwardly extending struts to the hull of the water vehicle; and means for releasably connecting the pods to the bottoms of the struts.

11. A method of delivering an object from an elongated water vehicle to a remote location comprising the steps of:

mounting the object in an elongated pod;

mounting the pod to the bottom of the vehicle with the longitudinal axes of the pod and the water vehicle substantially parallel with respect to one another;

releasing the pod from the vehicle;

downwardly gliding the pod in the water;

anchoring the pod to the bottom of the water with the pod oriented substantially horizontally above the bottom of the water; and opening the pod and removing the object therefrom.

12. A method as claimed in claim 11 wherein the object is a self-propelled torpedo, and including the step of:

opening the pod and self-propelling the torpedo therefrom.

13. A method as claimed in claim 12 wherein the torpedo is a mine, and including the step of:

self-propelling the torpedo-mine to a strategic bottom location and resting the torpedo-mine at said location for mining purposes.

* * * * *